US005475878A

United States Patent [19]

Dawn et al.

[11] Patent Number: 5,475,878

[45] Date of Patent: Dec. 19, 1995

[54] PROTECTIVE HELMET ASSEMBLY

[75] Inventors: Frederic S. Dawn, Houston; John D. Eck, League City; Fred R. Weiss, Friendswood, all of Tex.

[73] Assignee: The United States of America as represented by the Administrator of the National Aeronautics and Space Adminstration, Washington, D.C.

[21] Appl. No.: 971,116

[22] Filed: Nov. 4, 1992

[51] Int. Cl.[6] ..... A42B 3/10

[52] U.S. Cl. ..... 2/411; 2/412; 2/6.1

[58] Field of Search ..... 2/2.5, 6, 410, 412, 2/414, 424, 2.11, 5, 6.1, 6.6, 7, 411

[56] References Cited

U.S. PATENT DOCUMENTS

| | | | |
|---|---|---|---|
| 3,362,403 | 1/1968 | Fleming et al. | 2/6 |
| 3,994,023 | 11/1976 | Aileo et al. | 2/417 |
| 4,023,209 | 5/1977 | Frieder, Jr. et al | 2/6 |
| 4,109,323 | 8/1978 | Matthias | 2/410 |
| 4,562,112 | 12/1985 | Lee et al. | 428/318.6 |
| 4,566,445 | 1/1986 | Jelsma et al. | 128/70 |
| 4,627,114 | 12/1986 | Mitchell | 2/414 |
| 4,738,990 | 4/1988 | Nelb, II et al. | 521/108 |
| 4,764,238 | 8/1988 | Dastin et al. | 156/245 |
| 4,806,573 | 2/1989 | Lee | 521/157 |
| 4,855,332 | 8/1989 | Indyke | 521/185 |
| 4,866,104 | 9/1989 | Indyke | 521/185 |
| 4,874,452 | 10/1989 | Ferro | 156/308.6 |
| 4,874,648 | 10/1989 | Hill et al. | 428/35.9 |
| 4,898,763 | 2/1990 | Ferro | 428/159 |
| 4,908,265 | 3/1990 | Ferro | 428/318.4 |
| 4,908,877 | 3/1990 | White | 2/6 |
| 4,918,752 | 4/1990 | Briggs | 2/424 |
| 4,940,112 | 7/1990 | O'Neill | 181/290 |
| 4,980,004 | 12/1990 | Hill | 264/53 |

FOREIGN PATENT DOCUMENTS

| | | | |
|---|---|---|---|
| 0074658 | 3/1983 | European Pat. Off. | 2/410 |
| 2546381 | 11/1984 | France | 2/410 |
| 3620768 | 1/1988 | Germany | 2/410 |
| 2041724 | 9/1980 | United Kingdom | 2/410 |

*Primary Examiner*—C. D. Crowder
*Assistant Examiner*—Michael A. Neas
*Attorney, Agent, or Firm*—Russell E. Schlorff; James M. Cate

[57] ABSTRACT

A protective helmet assembly (10) comprising a hard ballistic outer shell (12) in a clam shell construction of hinged shell portions (14, 16), the front portion (14) being provided with a window opening (20) and a facial seal (34). A transparent visor (22) and sun visor (24) are pivotally mounted on the shell portion (14) and are positionable to cover the window with a seal (23) between the visor (22) and shell portion (14). Impact absorbing pads (31, 32) of open cell flexible polyimide foam material are attached to the inner surface of the hard shell portions (14, 16) by cooperative fastener strips (35, 36) of hook-and-loop material.

7 Claims, 2 Drawing Sheets

PROTECTIVE HELMET ASSEMBLY

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

1. Field of the Invention

This invention relates to a protective helmet assembly, and more particularly to a helmet assembly which comprises a hard outer shell and a helmet padding comprising a lightweight polyimide foam material which is affixed to the inner surface of the outer helmet shell for providing improved safety and impact resistance and reduced flammability, offgassing and toxicity characteristics for use in an oxygen enriched spacecraft cabin or in a high vacuum environment.

2. Background Art

Helmet assemblies which utilize padding materials inside a harder outer shell are of a wide variety of designs and materials. The paddings used in these assemblies, however, do not typically exhibit high resistance to ignition and combustion and are often characterized by shortcomings in safety and impact resistance. Typically with foam rubber or the like, they are also unsatisfactory for use in the vacuum environment, particularly under high vacuum conditions, because of their toxic offgassing and relatively high flammability, in an oxygen enriched spacecraft cabin environment.

A protective helmet assembly with a hard outer shell and flexible inner shell of impact absorbing material is disclosed in U.S. Pat. No. 4,023,209. The impact absorbing material in this patent is a synthetic aromatic polyimide resin which is subject to offgassing in a high vacuum environment.

U.S. Pat. No. 4,562,112 discloses a closed cell polyimide foam composition which has a high vapor-barrier characteristic.

U.S. Pat. Nos. 4,874,452, 4,898,763, and 4,908,265 disclose processes for production of cured polyimide foam compositions and articles manufactured therefrom. The articles are prepared by compressing and heat curing material formed by subjecting cured polyimide foam to pressurized steam. Although the articles are flame resistant, they are non-resilient, non-flexible and consequently, unsatisfactory for use as padding material.

SUMMARY OF THE INVENTION

The invention is a protective helmet assembly with improved safety and impact resistance, high resistance to ignition and combustion, and reduced offgassing. The assembly comprises a hard rigid ballistic outer shell with one or more impact absorbing pads fitted to the interior surface thereof. The pads are made of open cell flexible polyimide foam material, each of which is attached to the inner surface of the ballistic outer shell by cooperative VELCRO fastener strips of hook-and-loop material affixed respectively to the rigid outer shell and the impact absorbing pads. The helmet assembly with shell and pads is sized to fit relatively close over a wearer's head.

BRIEF DESCRIPTION OF THE DRAWINGS

FIG. 2(*b*) is a view in perspective of an impact absorbing pad which is affixed to the inner surface of the rear portion of the helmet of FIG. 1;

DETAILED DESCRIPTION OF THE INVENTION

Figure 1:
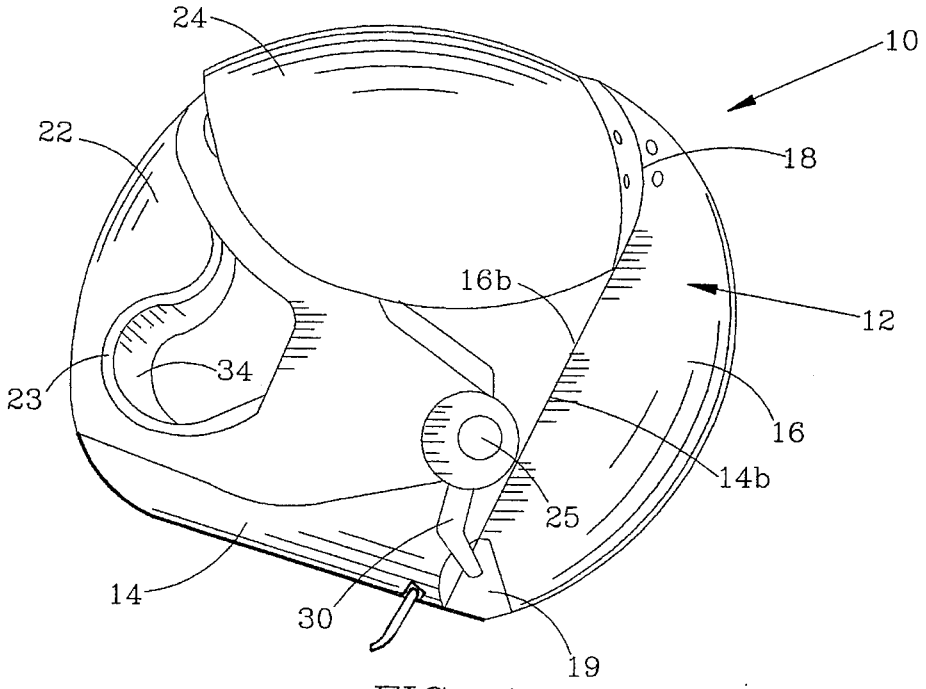
FIG. 1 is a perspective side view of a protective helmet assembly in accordance with the invention.

Referring more particularly to the drawings, there is shown in FIG. 1 a helmet assembly 10 in a preferred embodiment of the invention. The helmet assembly 10 comprises a hard rigid outer shell 12 fabricated in a two part clamshell-like construction of frontal and rear shell portions 14 and 16, respectively, which are joined by a hinged pivot connection 18 and by releasable latching mechanisms 19 on opposite sides of the helmet. The shell portions 14 and 16 are made from a polycarbonate polymer material.

The frontal shell portion 14 is provided with a window 20 and transparent visors 22, 24, respectively, which are attached to the shell portion 14 by pivot connections 25 at opposite sides thereof behind the window 20. The visor 22 is a transparent polycarbonate material, such as the commercial product LEXAN, with an outer surface which is painted about its peripheral margins to leave a clear transparent area conforming in configuration to that of the window 20. The visor 22 is adapted to be moved to a first pivotal position in covering relation to the window 20 or to a second pivotal position towards the rear of the frontal shell portion 14 wherein the window 20 is open and uncovered. Also, on its inner surface, about its peripheral margins, the window 20 is provided with a peripheral seal 23 which seals against the shell portion 14 when the visor 22 is positioned to cover the window 20.

The seal 23 is preferably an inflatable tube of silicone rubber, or the like, which is in a deflated state when the visor 20 is in the inoperative position but is adapted to receive oxygen or other inflating medium from a pressurized source through a rigid inlet connector conduit 30 which extends through an accommodating opening in the frontal helmet shell portion 14 and is fixed thereto. An ON-OFF valve (not shown) can be installed in the flexible connecting conduit from the oxygen supply to allow the helmet wearer to manually control the inflation of the seal 23 or the ON-OFF valve can be located in the rigid inlet conduit 30 with its actuating element positioned to automatically open the valve as the visor 22 is moved downward to operative position.

The helmet assembly 10 is also provided with a face seal 34 of a foamed elastomer material which is fixed to the inner surface of the frontal shell portion 14 by a suitable adhesive and extends in a closed loop about the peripheral margins of the window to encompass the eyes, nose and chin of the helmet wearer when the helmet is placed on the head of the helmet wearer. For some applications, it may be desirable that the inner surface of the seal 34 be contoured to conform to the face of the helmet wearer. An oxygen supply line from the conduit 30 and an exhaust line (not shown) communicate with the sealed area.

The outer visor 24 is a sun screen visor which is also pivotally movable between an out-of-the-way inoperative position towards the rear of the shell portion 14 and an operative position wherein it is superposed over the clear visor 22 for the purpose of filtering the sun's rays. The sun visor 24 is preferably of clear polycarbonate material with a conventional tinted film applied adhesively thereto which filters light of selected wavelengths.

Figure 3:
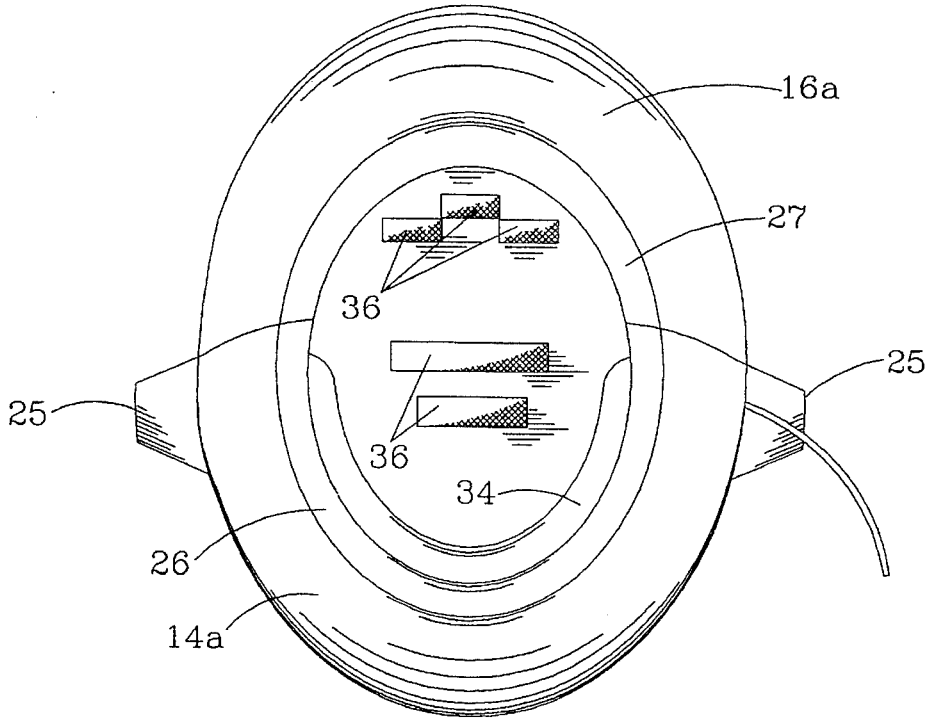
FIG. 3 is a view in perspective of the interior surface of the helmet of FIG. 1 showing the location thereon of fastener strips of hook-and-loop fastener material to which the pads of FIGS. 2(*a*) and 2(*b*) may be attached.
Figure 4:
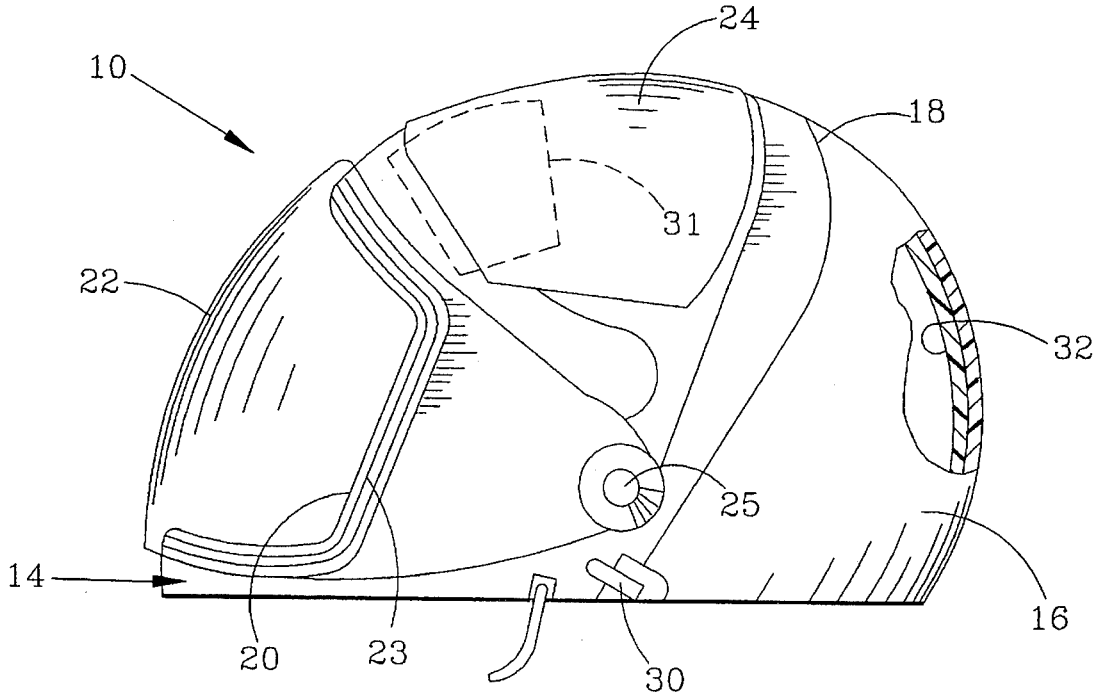
FIG. 4 is a side view of the helmet of FIG. 1 with parts thereof broken away to show details of construction.

As best seen in FIG. 3, the shell portions 14 and 16 are each provided at their lower ends with inwardly directed flanges, 14(*a*) and 16(*a*), respectively, and collar members 26, 27 of Neoprene or other rubber-like material fitted to the inner edges of the flanges 14(*a*) and 16(*a*). When the shell portions 14 and 16 are closed together, the collar members form a closed loop and are positioned to provide a relatively loose and flexible collar about the neck of the helmet wearer. Also the contacting edges 14*b*, 16*b* of respective shell portions 14, 16 are adapted to make a sealing connection with one another when closed together. A dovetail tongue and groove connection is preferred.

Figure 2A:
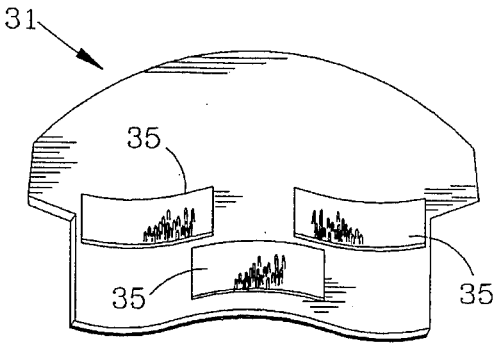
FIG. 2(*a*) is a view in perspective of an impact absorbing pad which is affixed to the inner surface of the frontal portion of the rigid outer shell of the helmet of FIG. 1.
Figure 2B:
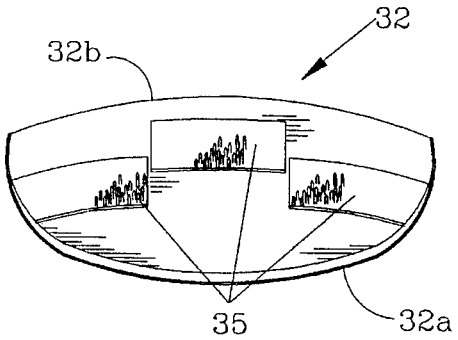

To protect the helmet wearer from injury from bumps or the like, the hard outer shell 12 is provided with a pair of impact absorbing pads 31, 32 respectively, as shown in FIGS. 2(*a*) and 2(*b*). Each of the pads 31, 32 is made of a foamed polyimide polymer in a thickness range of ¼ inch to ½ inch. The chemical structure of the polyimide, known commercially as SOLIMIDE, is:

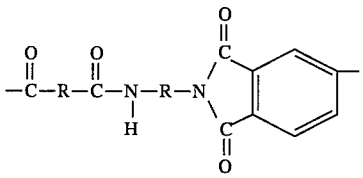

Particularly advantageous characteristics of this padding material are that it remains flexible and resilient in the temperature range of −300° F. (−184° C.) to +500° F. (260° C.), shows virtually no offgassing in a vacuum environment, and exhibits high resistance to ignition and combustion.

The pad 31 is a generally lune-shaped component designed to attach inside the rear hard shell portion 16 to protect the head of the helmet wearer. The pad 32 is of generally rectangular shape with a straight front edge 32(*a*) and an arcuate shaped rear edge 2(*b*). The pad 32 is designed to fit inside the hard shell portion 14. For attaching the pads to the hard shell of the helmet 10, each pad 31, 32 is provided on one surface with three fastener strips 35 attached thereto by a suitable adhesive which strips are designed to cooperatively engage with fastener strips 36 secured to the inner surface of the shell 12. The fastener strips 35, 36 are of conventional hook-and-loop material, such as the commercial product VELCRO, wherein the loops of the fastener strips 35 engage and releasably fasten to the hook material of the fastener strips 36.

The helmet assembly 10 illustrated herein, is a helmet worn by astronauts and test subjects in the United States Space Program during training in the space environmental chamber and the launch and entry phases of a space flight and may also be worn by astronauts in a space vehicle when in outer space as a protection against a sudden depressurization of the cabin. The materials used in the hard shell and impact absorbing pads of the helmet 10, meet the very strict requirements of space flight and qualification testing wherein it is very important that the helmet materials do not exhibit offgassing of toxic or hazardous materials and that they exhibit high resistance to ignition and combustion, particularly when in high oxygen atmospheres.

It is to be noted that the foamed polyimide polymer padding disclosed herein, need not be limited to application in a space helmet, but could be used with hard shell helmets of other kinds in very different environments and applications.

It is also to be understood that the foregoing description of a preferred embodiment of the invention has been presented for purposes of illustration and explanation and is not intended to limit the invention to the precise form disclosed. For example, the precise shape, number and arrangement of the fastener strips may be other than shown or even replaced by a different type of fastening means, such as buttons, zippers or the like. It is to be appreciated therefore that various material and structural changes may be made by those skilled in the art without departing from the spirit of the invention.

We claim:

1. A protective helmet assembly comprising:

a hard rigid ballistic outer shell having a clam shell construction including a frontal shell portion and a rear shell portion joined together by a hinged connection near the top of the helmet assembly whereby the shell portions are moveable between an open position which facilitates donning of the helmet, and a closed position wherein said shell portions are sized to fit relatively closely over a helmet wearer's head, said frontal shell portion having a window opening;

first and second impact absorbing pads in said frontal and rear shell portions, respectively, said second pad being spaced rearwardly from said first pad and from said frontal shell portion, each pad being disposed in a contour conforming relationship to an adjacent portion of the interior surface of the respective associated shell portion, and having an outer face conforming with the interior surface of the respective associated shell portion;

said pads being made of open cell polyimide foam material wherein said material is flexible and resilient in the temperature range of 330 to 500 degrees Fahrenheit and incapable of off-gas in a vacuum environment; and cooperative fastener means fixed to the inner surfaces of each of the shell portions and to the outer surfaces of each of said pads to releasably attach the impact absorbing pads in the helmet assembly, each impact absorbing pad comprising resilient means postionable between the interior surface of the respective, associated shell portion and a wearer's head for protecting the wearer's head from injury.

2. A protective helmet assembly as set forth in claim 1, wherein said fastener means comprises fastener strips of hook-and-loop material wherein said strips of hook material are fixed to either said outer shell portions or said pads, and wherein strips of loop material are fixed to the other.

3. A protective helmet assembly as set forth in claim 1, wherein said first and second pads extend laterally across said frontal and rear shell portions, respectively.

4. A protective helmet assembly as set forth in claim 1, wherein said first and second pads are laterally centered within said frontal and rear shell portions, respectively, for contacting upper and rear portions of a wearer's head.

5. A protective helmet assembly as set forth in claim 1, wherein said first and second impact absorbing pads comprise means for contacting the head of a wearer and for supporting the helmet thereon.

6. A protective helmet assembly as set forth in claim 1, comprising at least one impact absorbing pad, including said first impact absorbing pad, in said frontal shell portion and at least one impact absorbing pad, inclduing said second impacting absorbing pad, in said second shell portion.

7. A protective helmet assembly as set forth in claim 1 wherein said polyimide foam material is of the formula.

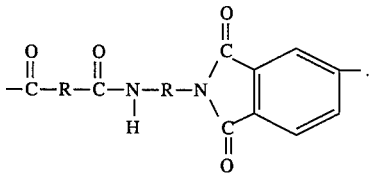

* * * * *